US006079819A

United States Patent [19]

Deshpande et al.

[11] Patent Number: 6,079,819

[45] Date of Patent: Jun. 27, 2000

[54] INK JET PRINTHEAD HAVING A LOW CROSS TALK INK CHANNEL STRUCTURE

[75] Inventors: Narayan V. Deshpande, Penfield; John R. Andrews, Fairport; Dale R. Ims, Webster, all of N.Y.

[73] Assignee: Xerox Corporation, Stamford, Conn.

[21] Appl. No.: 09/004,640

[22] Filed: Jan. 8, 1998

[51] Int. Cl.[7] ..... B41J 2/05

[52] U.S. Cl. ..... 347/65; 347/63

[58] Field of Search ..... 347/54, 56, 61, 347/63, 65

[56] References Cited

U.S. PATENT DOCUMENTS

| | | | |
|---|---|---|---|
| Re. 32,572 | 1/1988 | Hawkins et al. | 156/626 |
| 4,774,530 | 9/1988 | Hawkins . | |
| 4,835,553 | 5/1989 | Torpey et al. . | |
| 4,947,192 | 8/1990 | Hawkins et al. . | |
| 4,947,193 | 8/1990 | Deshpande . | |
| 5,132,707 | 7/1992 | O'Neill . | |
| 5,198,834 | 3/1993 | Childers et al. . | |
| 5,385,635 | 1/1995 | O'Neill | 347/65 X |
| 5,665,249 | 9/1997 | Burke et al. . | |
| 5,686,224 | 11/1997 | O'Neill . | |
| 5,699,094 | 12/1997 | Burke et al. | 347/63 |
| 5,708,465 | 1/1998 | Morita et al. | 347/65 |
| 5,760,803 | 6/1998 | Yamamoto et al. | 347/65 X |
| 5,870,123 | 2/1999 | Lorenze, Jr. et al. | 347/65 |
| 5,912,685 | 6/1999 | Ramon | 347/65 |

*Primary Examiner*—Sandra Brase
*Attorney, Agent, or Firm*—Robert A. Chittum

[57] ABSTRACT

An ink jet printhead is disclosed which has a heater plate containing the heating elements and driving circuitry means monolithographically formed on one surface thereof and the ink flow directing channel structure is formed on the heater plate using a layer of patternable polymeric material which, in one embodiment, is exposed using a mask to define the channel pattern then developed and cured. After curing, the patterned channel structure is polished to provide a smooth coplanar surface and a cover plate with an aperture therein is aligned and bonded to the channel structure to complete the printhead. The aperture serves as both ink inlet and a portion of the ink reservoir. The channels are open at one end and serve as the droplet ejecting nozzles, while the other ends are closed and extend beneath the cover plate aperture to provide a baffled portion of the ink reservoir and prevent cross-talk between the ink channels. In another embodiment, the channels ends opposite the nozzles open into a common recess with the channels walls extending therein to function as baffles and prevent cross-talk.

12 Claims, 6 Drawing Sheets

INK JET PRINTHEAD HAVING A LOW CROSS TALK INK CHANNEL STRUCTURE

BACKGROUND OF THE INVENTION

This invention relates to ink jet printing devices and more particularly to thermal ink jet printheads having a patternable ink flow directing channel structure with a geometry to minimize crosstalk.

In one conventional thermal ink jet printhead, the printhead consists of two sections, a heater plate and a channel plate. Some geometrical features are formed in both plates in such a way that, when bonded together, they form the desired configuration for ink droplet ejection. For example, U.S. Pat. No. 4,774,530 discloses a printhead in which upper and lower silicon substrates are mated and bonded together with a thick film insulative layer sandwiched therebetween. One surface of the upper substrate or channel plate has a plurality of parallel grooves and a recess etched therein. When mated with the lower substrate or heater plate, the grooves and recess form the printhead ink channels and ink reservoir, respectively. The grooves are open at one end and closed at the other end. The channel open ends serve as the printhead nozzles. The channel closed ends are closely adjacent the reservoir and placed in fluid communication therewith by a patterned recess in the thick film layer. Each channel is capillarily filled with ink from the reservoir and has a heating element located upstream of the nozzles. Each heating element is selectively addressable by electrical pulses representative of data signals to produce momentary vapor bubbles in the ink to effect the ejection of ink droplets from the printhead nozzles and propel them to a recording medium. The thick film layer is also patterned to expose the heating elements and thereby place the heating elements in a pit to better contain the vapor bubble and prevent ingestion of air.

This printhead construction has some drawbacks. For example, the silicon channel plate is anisotropically or orientation dependent etched to form straight, triangularly shaped grooves when non-straight grooves provide more design flexibility and non-triangular shaped nozzles assist in droplet directionality. In addition, an etched silicon channel plate means separate fabrication of the two plates and the necessity of very accurate alignment between the two when they are mated. Because silicon is opaque, it is difficult to determine if the adhesive is coating all of the surface areas required to separate the channels and to prevent internal ink leaks.

U.S. Pat. No. 5,132,707 discloses a thermal ink jet printhead having an array of coplanar nozzles in a nozzle face that are entirely surrounded by a polymeric material. The ink channels, nozzles, and ink reservoir are produced by sequentially depositing and patterning two layers of polymeric material, such as, for example, Vacrel®, on the heater plate, so that the heating elements are placed in a pit in the first layer and the channels and reservoir recesses are produced in the overlying second layer. The cover plate has a third layer of identical polymeric material with a hole through both the cover plate and third layer to serve as the ink inlet. The cover plate with the third layer is aligned and bonded to the second layer with the cover plate hole aligned with the reservoir recess in the second layer to produce the printhead.

U.S. Pat. No. 5,198,834 discloses a printhead or pen head for a droplet-on-demand ink jet printer or pen which utilizes a barrier wall located between a substrate and an orifice plate. The ink flows through the printhead in channels defined in the barrier wall. The barrier wall is fabricated in two layers from cured, photoimaged resist materials. One layer is a soldermask material, and the other is a photolithographic resist material. The two layers together resist chemical attack by the ink and separation of the orifice plate from the printhead.

Pending U.S. Patent Application Ser. No. 08/712,761, filed Sep. 12, 1996, entitled "Method and Materials For Fabricating An Ink Jet Printhead," and assigned to the same assignee as the present invention discloses an ink jet fabrication technique which enables capillary channels for liquid ink to be formed with square or rectangular cross-sections. A sacrificial layer is placed over the main surface of a silicon chip, the sacrificial layer being patterned in the form of the void formed by the desired ink channels. A permanent layer comprising a permanent material is applied over the sacrificial layer and, after polishing the two layers to form a uniform layer which exposes some of the surfaces of the sacrificial layer, the sacrificial layer is removed to form open ink channels. A cover plate is bonded to the patterned permanent material to provide the closed ink channels and produce the printhead. Preferred sacrificial layer materials include polyimide while the preferred permanent layer materials include polyarylene ether.

SUMMARY OF THE INVENTION

It is an object of the invention to provide an ink jet printhead having an ink channel structure which is formed directly on the heater plate, wherein said channel structure minimizes fluidic crosstalk between neighboring channels.

In one aspect of the present invention, there is provided an ink jet printhead having a low cross talk channel structure, comprising: a heater plate having on one surface thereof an array of heating elements, driving circuitry means, and interconnecting leads including contacts for the selective application of electrical pulses to each of the heating elements, each of the selectively applied pulses ejecting an ink droplet from the printhead; a passivation layer covering the heater plate surface and the driving circuitry means and interconnecting leads thereon, the heating elements and contacts being free of the passivation layer; a patternable polymer layer being deposited on the passivation layer and patterned to expose the contacts and to form a plurality of parallel channel grooves therein with opposing ends, each channel groove containing and exposing therein a heating element, one end of the channel grooves being open and each of the opposing ends being closed; and a cover plate having an aperture and being bonded to the patternable polymer layer to form the ink channels from the channel grooves and nozzles from the channel open ends, the aperture being aligned with the closed ends of the channel grooves to provide both an ink inlet and an ink reservoir.

In one embodiment of the invention, the cover plate aperture has a size sufficient to expose the closed end portions of the channel grooves in such a manner that the walls between channel grooves in the vicinity of the closed ends thereof extend into the space functioning as the ink reservoir and provide a geometry which eliminates crosstalk between the ink channels ejecting droplets and the adjacent ink channels that are not ejecting droplets.

In another embodiment, the channel groove ends opposite the open ends connect to a common recess which will subsequently serve as a portion of the printhead reservoir. In a further embodiment the ends of the channel grooves which connect to the common recess have walls which extend into the common recess by varying distances.

BRIEF DESCRIPTION OF THE DRAWINGS

The present invention will now be described by way of example with reference to the accompanying drawings, wherein like reference numerals refer to like elements and in which.

DESCRIPTION OF THE PREFERRED EMBODIMENT

Figure 1:
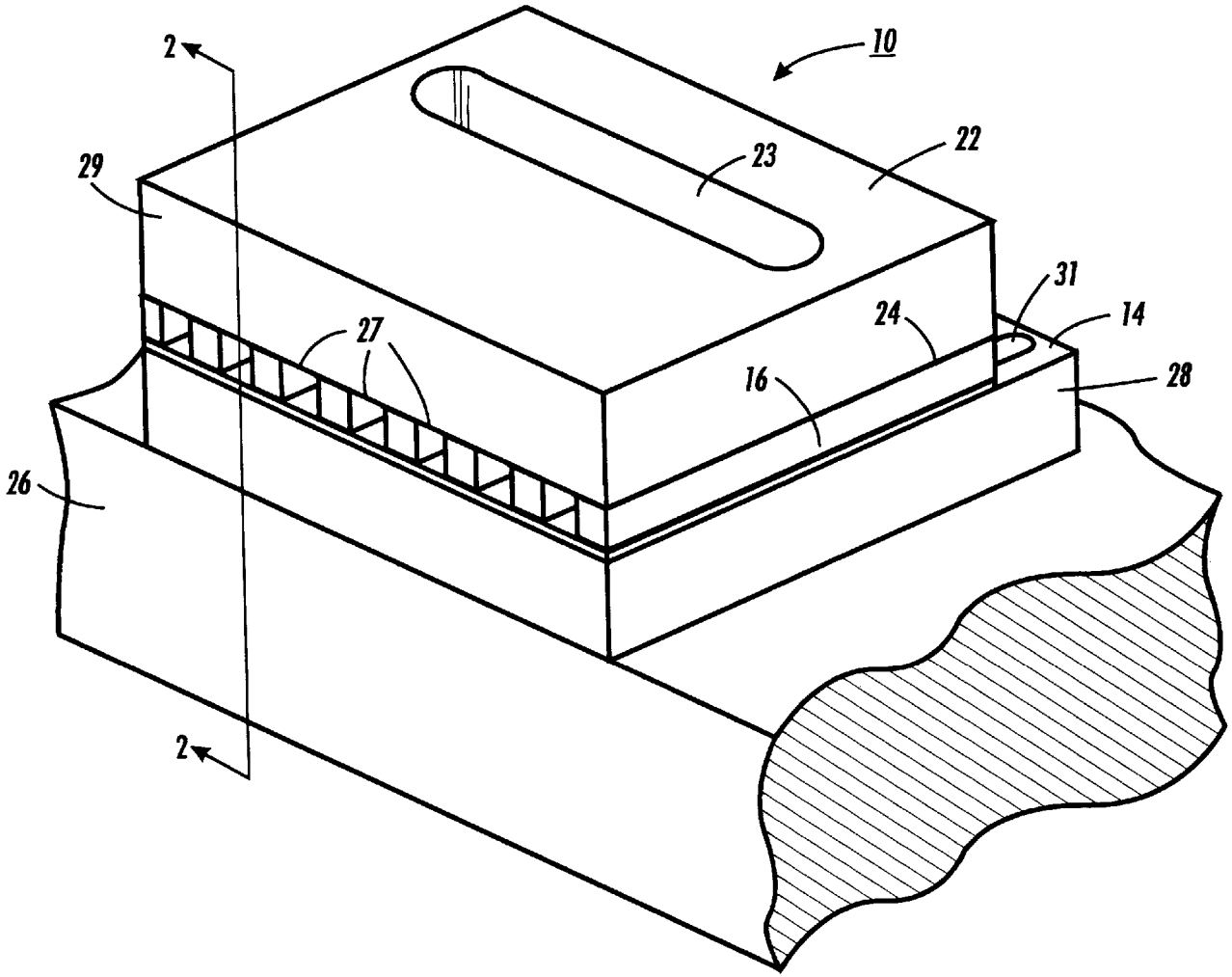
FIG. 1 is a schematic isometric view of a printhead in accordance with the present invention and oriented so that the droplet ejecting nozzles are shown.
Figure 2:
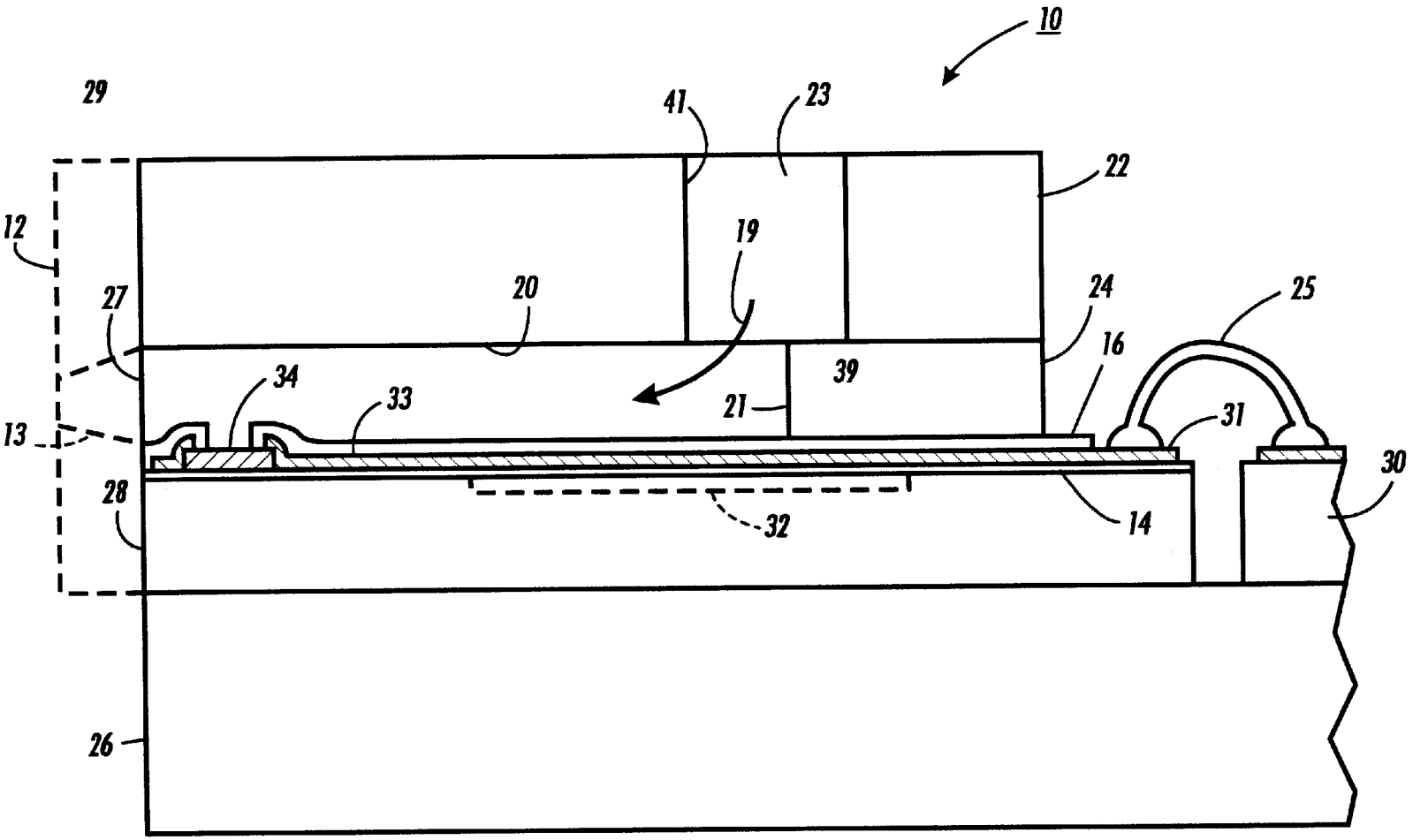
FIG. 2 is a cross-sectional view of FIG. 1 as viewed along the view line 2—2 thereof.

In FIG. 1, a schematic isometric view of an ink jet printhead 10 in accordance with the present invention is shown mounted on a heat sink 26 and oriented to show the front face 29 of printhead and the array of droplet ejecting nozzles 27 therein. Referring also to FIG. 2, a cross-sectional view of FIG. 1 taken along view line 2—2 through one ink channel 20, the silicon heater plate 28 has the heating elements 34, driving circuitry means 32 represented by dashed line, and leads 33 interconnecting the heating elements and driving circuitry means and having contacts 31 connected to a printed circuit board 30 by wire bonds 25. The circuit board is connected to a controller or microprocessor of the printer (neither shown) for selectively applying a current pulse to the heating elements to eject ink droplets from the nozzles. One suitable driving circuitry means is described in U.S. Pat. No. 4,947,192 and is hereby incorporated by reference. Generally, an underglaze layer 14 is formed on the heater plate surface on which the heating elements, driving circuitry means, and leads are to be formed, followed by a passivation layer 16 which is patterned to expose the heating elements and contacts.

Although the preferred embodiment has a photosensitive polymer layer, any patternable material which is not attacked by the ink would be sufficient, and any wet or dry etching process could be used to pattern the patternable material, including reaction ion etching (RIE) or photolithography. A photosensitive polymeric material is deposited over the heater plate to form the photopolymer layer 24 and photolithographically patterned to produce the ink channels 20 having an open end to serve as a nozzle 27 and a closed end 21 and to expose the contacts 31 of the electrical leads. A cover plate 22 of glass, quartz, silicon, polymeric, or ceramic material has an aperture 23 therethrough, and is bonded to the surface of the patterned photopolymer layer 24 with a suitable adhesive (not shown). The cover plate aperture 23 has a size suitable to expose portions of the closed ends 21 of the channels and to provide an adequate ink supply reservoir for the printhead, when combined with closed end portions 21 of the channels. The ink flow path from the reservoir to the channels 20 is indicated by arrow 19. An optional nozzle plate 12 is shown in dashed line which is adhered to the printhead front face 29 with the nozzles 13 therein aligned with the open ends 27 of the channels 20 in the photopolymer layer 24.

As disclosed in U.S. Pat. Nos. Re. 32,572, 4,774,530, and 4,947,192 all of which are incorporated herein by reference, the heater plates of the present invention are batch produced on a silicon wafer (not shown) and later separated into individual heater plates 28 as one piece of the printhead 10. As disclosed in these patents, a plurality of sets of heating elements 34, driving circuitry means 32, and electrical leads 33 are patterned on a polished surface of a (100) silicon wafer which has first been coated with an underglaze layer 14, such as silicon dioxide having a thickness of about 1–5 $\mu$m. The heating elements may be any well known resistive material such as zirconium boride, but is preferably doped polycrystalline silicon deposited, for example, by chemical vapor deposition (CVD) and concurrently monolithically fabricated with the driving circuitry means as disclosed in U.S. Pat. No. 4,947,193. Afterwards, the wafer is cleaned and re-oxidized to form a silicon dioxide layer (not shown) over the wafer including the driving circuitry means. A phosphorous doped glass layer or boron and phosphorous doped glass layer (not shown) is then deposited on the thermally grown silicon dioxide layer and is reflowed at high temperatures to planarize the surface. As is well known, photoresist is applied and patterned to form vias for electrical connections with the heating elements and driving circuitry means and aluminum metallization is applied to form the electrical leads and provide the contacts for wire bonding to the printed circuit board which in turn is connected to the printer controller. Any suitable electrically insulative passivation layer 16, such as, for example, polyimide, polyarylene ether ketone, polybenzoxazole, or bisbenzocyclobutene (BCB), is deposited over the electrical leads to a thickness of about 0.5 to 20 $\mu$m and removed from the heating elements and contacts.

Figure 8:
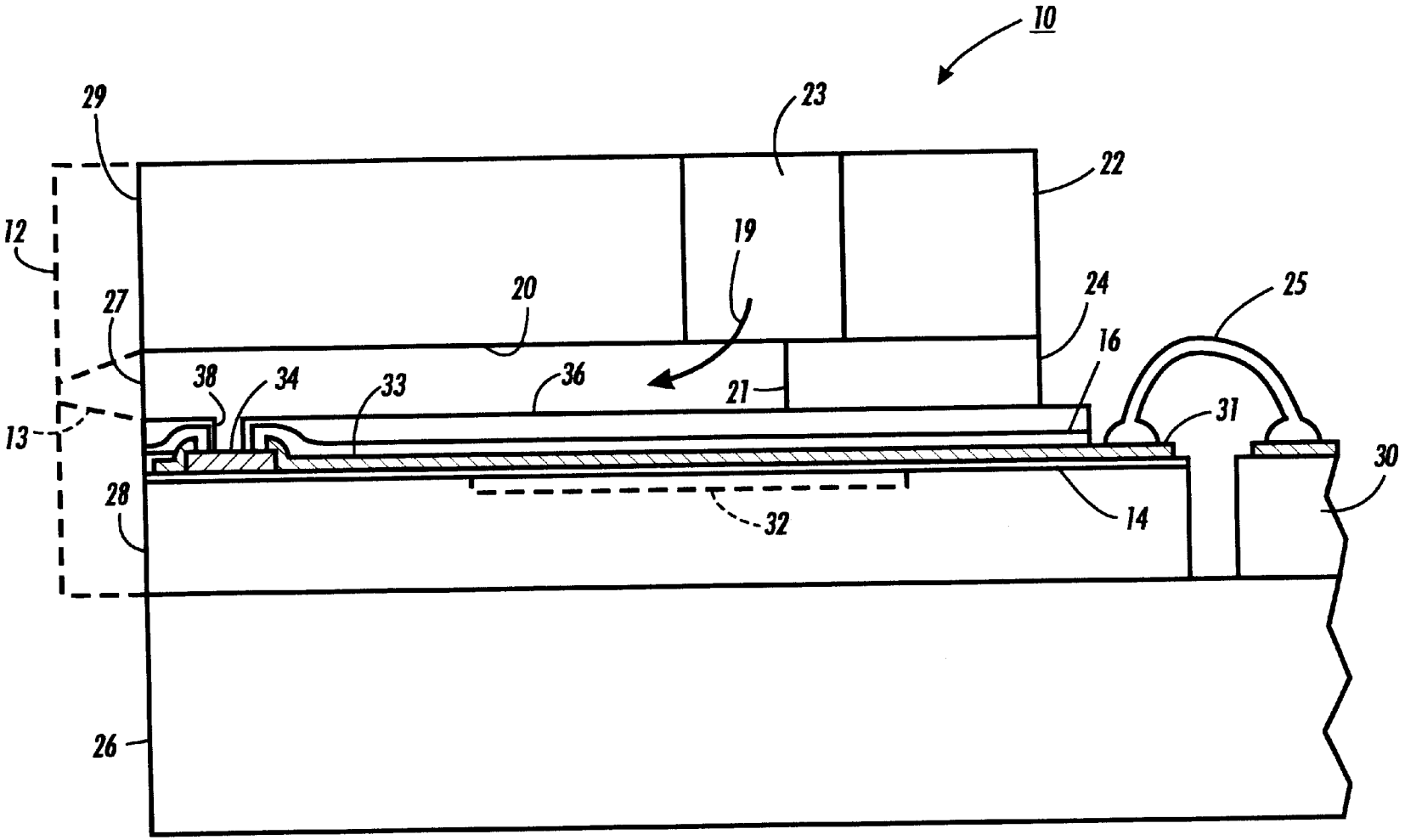
FIG. 8 is a cross-sectional view similar to FIG. 2 showing another embodiment of the present invention.

Next, an optional pit layer 36 of, for example, polyimide or BCB, may be deposited and patterned to provide pits 38 for the heating elements as shown in FIG. 8 and disclosed in U.S. Pat. No. 4,774,530. The optional pit layer 36 is deposited and patterned prior to the deposition of the photopolymer layer 24. However, for high resolution printheads having nozzles spaced for printing at 400 spots per inch (spi) or more, heating element pits have been found not to be necessary, for the vapor bubbles generated to eject ink droplets from nozzles and channels of this size tend not to ingest air.

If the topography of the heater wafer is uneven, the wafer is polished by techniques well known in the industry, such as that disclosed in U.S. Pat. No. 5,665,249 and incorporated herein by reference. Then the photopattemable polymer layer which is to provide the channel structure 24 is deposited. As disclosed in U.S. application Ser. No. 08/712,761 filed Sep. 12, 1996, mentioned above, and incorporated herein by reference, a suitable channel structure material must be resistant to ink, exhibit temperature stability, be relatively rigid, and be readily diceable. The most versatile material for a channel structure is polyimide or polyarylene ether ketone (PAEK). In the preferred embodiment, OCG 7520™ polyimide is used, and because polyimide shrinks about 30 to 50% when cured, this must be taken into account when depositing a layer of polyimide on the heating element wafer. After deposition of the polyimide, it is exposed using a mask with the channel sets pattern and contacts pattern. The patterned polyimide channel structure layer is developed and cured. In one embodiment, the channel structure thickness is 30 $\mu$m, so the original thickness deposited is about 65 μm, which shrinks to about 33 μm when cured and is then polished to the desired 30 μm by the same technique used to polish the surface of the heater wafer mentioned above. For the embodiment having a channel structure thickness of 16 μm, the original thickness deposited must be about 40 μm, which shrinks to about 20 μm when cured and is then polished to the desired 16 μm thickness. After the patterned polyimide layer 24 is cured and polished, a cover plate 22, the same size as the wafer and having a plurality of apertures 23 therein, is bonded to the polyimide layer. The cover plate 22 serves as the closure for the channels 20 and the cover plate aperture 23, which is an opening through the cover plate, serves as an ink inlet to the reservoir as well as most of the ink reservoir. The silicon wafer and wafer size cover plate with the channel structure sandwiched therebetween are separated into a plurality of individual printheads by a dicing operation. The dicing operation not only separates the printheads, but also produces the printhead front face 29 and opens one end of the channels to form the nozzles 27.

Figure 3:
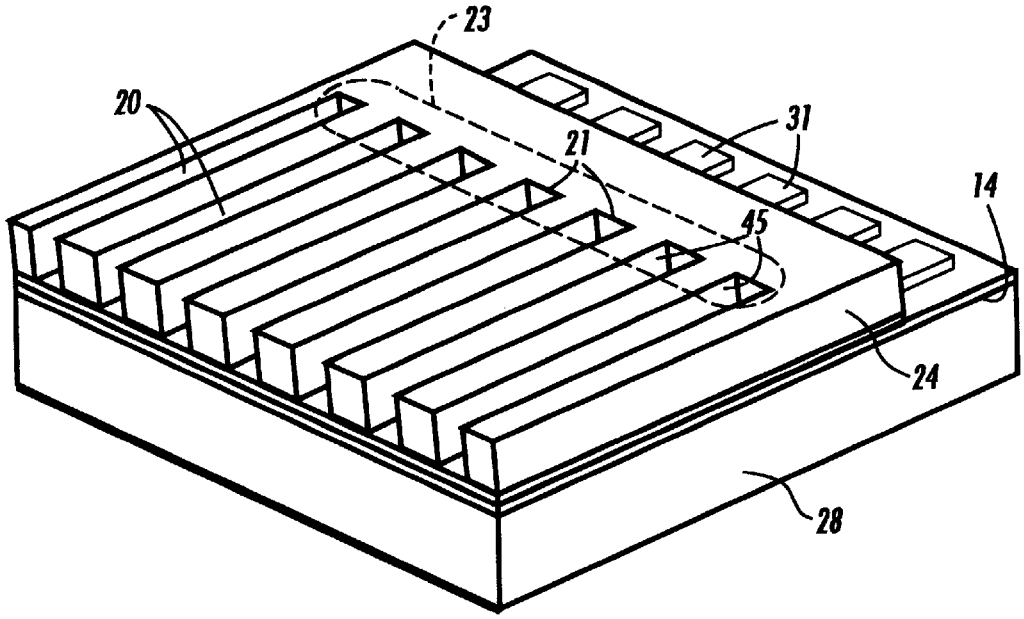
FIG. 3 is a schematic isometric view of the printhead of FIG. 1 without the cover plate.

Referring to FIG. 3, a schematic isometric view of a portion of the heater wafer is shown, comprising a single heater plate 28 having the patterned, cured, and polished polyimide channel structure 24 thereon. The cover plate is omitted, but the aperture 23 therein is shown in dashed line, so that the position of the ink inlet and reservoir provided by the aperture relative to the channel closed ends 21 is identified. This geometry of the closed end portions of the channels and cover plate aperture defines the ink reservoir as including the closed end portions of the channels. Thus, the portion of the channel walls 45 which extend into the reservoir act as a baffle when a heating element is addressed with an electrical pulse to form an ink vapor bubble which concurrently causes the ejection of an ink droplet and a back pressure towards the reservoir. The back pressure produces a flow of ink into the reservoir with the baffling walls of the channels causing the ink to flow upward and away from the neighboring channels. Since the reservoir portion comprising the relatively large cover plate aperture provides much less flow resistance than that of the portion comprising the closed end portions of the neighboring channels, the primary back flow path is, therefore, into the aperture portion of the reservoir and not into the neighboring channels. Without the channel walls to baffle the ink back flow, the ink at the nozzles of the adjacent non-addressed or non-fired channels would bulge out significantly and weep onto and wet the front face 29 of the printhead in the regions surrounding the nozzles 27. Thus, the adjacent or nearest nozzle to the nozzle ejecting a droplet tends to flood ink onto the front face, while an unfired or non-ejecting nozzle which is sandwiched between two nozzles which are ejecting droplets may also cause the ejection of an ink droplet. This affect on the adjacent or near non-fired channels by the fired channels is termed "cross-talk."

Figure 4:
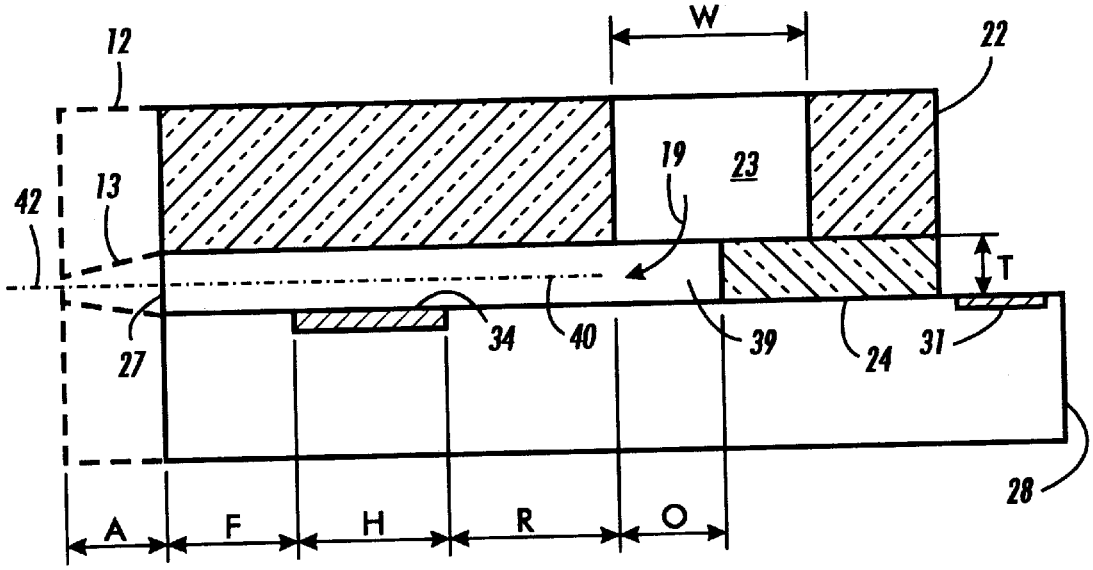
FIG. 4 is a view similar to that of FIG. 2 showing the dimensional spacing between portions of the ink channel.

FIG. 4 is similar to FIG. 2, with the various channel portions identified. For the preferred embodiment of a 600 spi printhead, the cover plate has a thickness of about 25 to 500 μm and the aperture is an elongated slot having a length sufficient to extend across all of the channels and has a width 'W' of 100 to 1000 μm. The thickness 'T' of the channel structure 24 is about 16–30 μm and the channel width is about 30 μm, so that in one embodiment, the channel cross-section is about 30 μm×30 μm. The frequency response is controlled by the rear channel length 'R' which is about 50 μm. The rear end portion 'O' of the channels or the portion of the closed end portion which extends into and becomes a part of the reservoir affects the refill of the channels, if they are too small, but for sufficiently large openings that parameter has no effect on droplet ejection or refill. A sufficient dimension for the rear end portion 'O' is equal to or greater than 25 μm. The required refill parameters and the control of cross-talk can be achieved by adjusting the dimensions R, O, and T. The heating element is about 50–100 μm long ('H') and about 25 μm wide. The heating element is spaced upstream from the nozzle or front face by the dimension 'F' of about 40–90 μm, but preferably 50 μm. The optional nozzle plate 12 shown in dashed line is about 50 μm thick and has a conical shaped nozzle 13 for each nozzle 27 in the printhead front face. The conical shaped nozzle is aligned and has its axis 42 substantially coincident with the axis 40 of the channels. The outside opening of the nozzle 13 is about 17 μm in diameter and the inside opening adjacent the nozzle 27 is about 26 μm in diameter.

Figure 5:
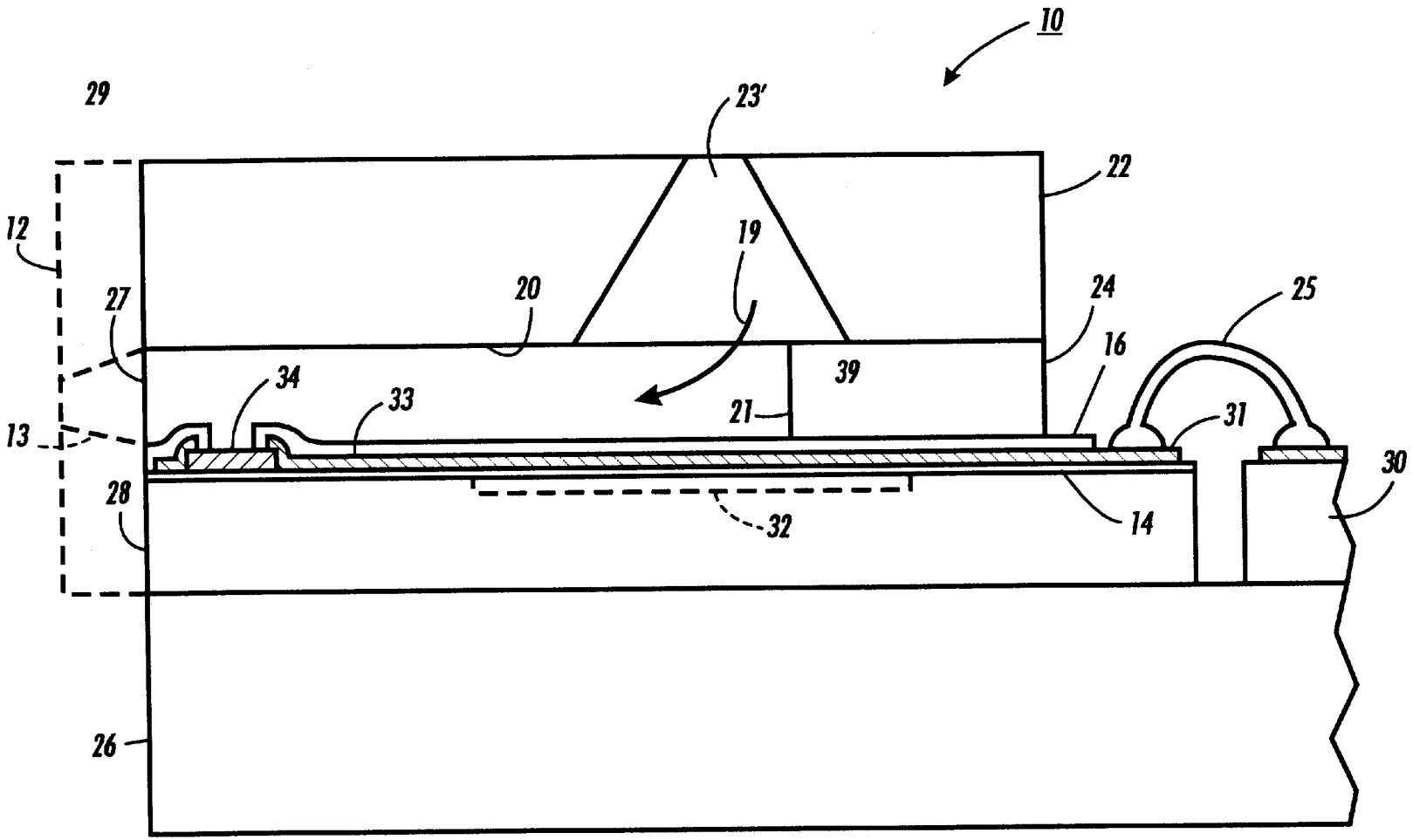
FIG. 5 is a view similar to FIG. 2 showing an alternate embodiment of the printhead cover plate.

FIG. 5 is a view similar to FIG. 2, but showing an alternate embodiment of the cover plate. In this embodiment, a silicon substrate is utilized for the cover plate 22' and has an aperture 23' formed by orientation dependent etching (ODE). The etching is done from the silicon cover plate surface which is to be bonded against the channel structure 24, thereby providing a different cross-sectional shape for the reservoir.

Figure 6:
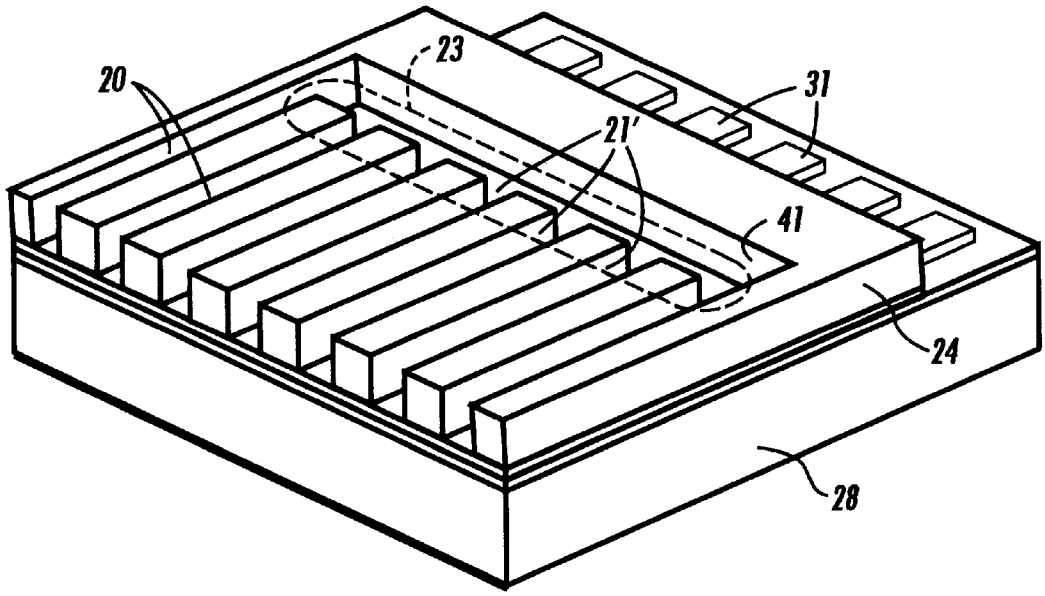
FIG. 6 is a view similar to FIG. 3 showing an alternate embodiment wherein the channel grooves open into a common recess with the walls of the channel grooves extending into the printhead reservoir.

Referring to FIG. 6, another embodiment is shown of the channel structure 24 in a view similar to that of FIG. 3. In this embodiment, the channel ends 21' connect and open into a common recess 41. Because walls 45 of the channels 20 extend into the reservoir formed by combination of the cover plate aperture 23, common recess 42, and end portions of the channels ends 21' by the distance 'O' of at least 25 μm, cross-talk is prevented.

Figure 7:
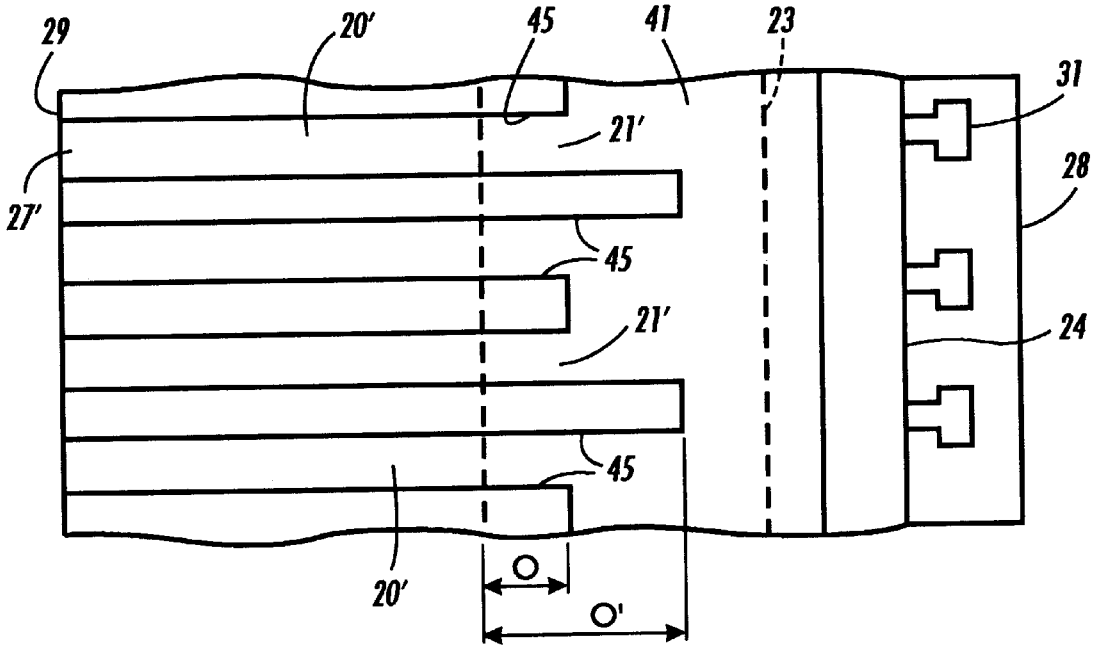
FIG. 7 is a partially shown plan view of an alternate embodiment of the printhead without the cover plate showing the channel groove walls extending into the reservoir by varying distances.

FIG. 7 is an alternate embodiment of the channel structure 24 in FIG. 6. In this embodiment of a printhead, a partially shown plan view of the channel structure 24 is depicted showing that the channel walls 45 of the channels ends 21' vary in the distance in which they extend into the reservoir portion formed by the cover plate aperture 23 as represented by 'O' and O', where O is at least 25 μm and O' is greater than O. Any combination of varying channel wall extensions into the reservoir may be used, such as, the walls of the outer channels of particular groups of channels (not shown) may extend further into the reservoir than the intervening channel walls.

FIG. 8 is a cross-sectional view similar to that of FIG. 2, but has a pit layer 36 taught by U.S. Pat. No. 4,774,530. The pit layer 36 may be useful for printheads having a resolution of less than 400 spi, but may be used for higher printing resolution printheads. Except for the pit layer, the printhead and method of fabrication is same as for the printhead in FIGS. 1 and 2.

Although the foregoing description illustrates the preferred embodiment, other variations are possible and all such variations as will be apparent to those skilled in the art are intended to be included within the scope of this invention as defined by the following claims.

We claim:

1. An ink jet printhead having a patternable ink channel structure which minimizes cross-talk, comprising:

a heater plate having on one surface thereof an array of heating elements, driving circuitry means, and interconnecting leads including contacts for the selective application of electrical pulses to each of the heating elements, each of the selectively applied pulses ejecting an ink droplet from the printhead;

a passivation layer covering the heater plate surface and the driving circuitry means and interconnecting leads thereon, the heating elements and contacts being free of the passivation layer;

a patternable layer being deposited on the passivation layer and patterned to expose the contacts and to form a common recess and a plurality of parallel channel grooves therein with opposing ends, each channel groove containing and exposing therein a heating element, one end of the channel grooves being open and the opposing end being connected to the common recess; and a cover plate having an aperture, the cover plate being aligned and bonded to the patternable layer to form ink channels from the channel grooves and nozzles from the channel open ends, the aperture being aligned over at least a portion of the common recess and a portion of the ends of the channel grooves which are connected to the common recess, so that the aperture and common recess form an ink reservoir for the printhead and the aperture provides an ink inlet to said reservoir while the channel end connected to the common recess extend into said ink reservoir and function as baffles to prevent cross-talk between channels when the printhead is printing.

2. The printhead as claimed in claim 1, wherein the patternable layer is a photopatternable polymeric material.

3. The printhead as claimed in claim 2, wherein the walls of the channel grooves extend into the reservoir for a distance 'O' of at least 25 $\mu$m.

4. The printhead as claimed in claim 3, wherein the cover plate may be fabricated from either glass, quartz, silicon, polymeric, or ceramic material.

5. The printhead as claimed in claim 1, wherein each of the channel ends which extend into the reservoir alternately extend a varying distance into said reservoir.

6. The printhead as claimed in claim 5, Wherein one of said alternately extending channel ends extends into the reservoir for a distance of at least 25 $\mu$m and an adjacent channel end extends a great distance into the reservoir.

7. An ink jet printhead having a patternable ink channel structure which minimizes cross-talk, comprising:

a heater plate having on one surface thereof an array of heating elements, driving circuitry means, and interconnecting leads including contacts for the selective application of electrical pulses to each of the heating elements, each of the selectively applied pulses ejecting an ink droplet from the printhead;

a passivation layer covering the heater plate surface and the driving circuitry means and interconnecting leads thereon, the heating elements and contacts being free of the passivation layer;

a patternable layer being deposited on the passivation layer and patterned to expose the contacts and to form a plurality of parallel channel grooves and a reservoir groove therein, the channel grooves each having a heating element therein, each channel groove having an open end and an opposite end which connects to the reservoir;

a cover plate having an aperture, the cover plate being aligned and bonded to the patternable layer to form ink channels from the channel grooves, nozzles from the channel groove open ends, and ink reservoir for the printhead from the combination of the reservoir groove, channel ends which connect to the reservoir groove, and aperture, the aperture providing the inlet to the printhead reservoir; and the channel ends connecting to the reservoir groove having walls which extend into the printhead reservoir a predetermined distance and provide baffling of back flow from channel which eject ink droplets and to prevent crosstalk.

8. The printhead as claimed in claim 7, wherein each of the channel walls alternately extend into the printhead reservoir by varying distances.

9. The printhead as claimed in claim 8, wherein one of said channel wall extends into the printhead reservoir for a distance of at least 25 $\mu$m and adjacent channel wall extends a greater distance into the printhead reservoir.

10. The printhead as claimed in claim 7, wherein the predetermined distance that the channel groove walls extend into the printhead reservoir is at least 25 $\mu$m.

11. The printhead as claimed in claim 7, wherein the cover plate may be fabricated from either glass, quartz, silicon, polymeric, or ceramic material.

12. The printhead as claimed in claim 7, wherein the patternable layer is a photopatternable polymeric material.

* * * * *